US005119908A

United States Patent [19]

Korhonen

[11] Patent Number: 5,119,908

[45] Date of Patent: Jun. 9, 1992

[54] PROCEDURE FOR MOUNTING THE GUIDE RAILS FOR AN ELEVATOR CAR OR COUNTERWEIGHT, AND A MOUNTING SYSTEM IMPLEMENTING THE PROCEDURE

[75] Inventor: Helge Korhonen, Oitti, Finland

[73] Assignee: Kone Elevator GmbH, Baar, Switzerland

[21] Appl. No.: 520,879

[22] Filed: May 9, 1990

[30] Foreign Application Priority Data

May 9, 1989 [FI] Finland ..... 892220

[51] Int. Cl.[5] ..... B66B 7/02

[52] U.S. Cl. ..... 187/95; 29/429

[58] Field of Search ..... 187/1 R, 95; 238/349; 29/429

[56] References Cited

U.S. PATENT DOCUMENTS

| | | | |
|---|---|---|---|
| 2,848,077 | 8/1958 | Tofanelli | 189/35 |
| 3,851,736 | 12/1974 | Westlake et al. | 187/95 |
| 3,893,219 | 7/1975 | Davis | 29/429 |
| 3,982,692 | 9/1976 | Feyrer | 238/349 |
| 4,345,671 | 8/1982 | Tosato et al. | 187/95 |
| 4,431,087 | 2/1984 | Karol | 187/95 |
| 4,577,729 | 3/1986 | Karol | 187/95 |
| 4,593,794 | 6/1986 | Russeau | 187/95 |

*Primary Examiner*—Robert P. Olszewski
*Assistant Examiner*—Kenneth Noland

[57] ABSTRACT

The invention relates to a procedure for mounting the guide rails for an elevator car or counterweight, wherein the guide rails are attached to an intermediate beam laid across the elevator shaft, the beam being attached at least by one of its ends to opposite walls of the elevator shaft, and to a mounting system implementing the procedure. At least two steel plates (5,6) or equivalent are placed oppositely on the vertical sides of the intermediate beam (2), the upper and lower edges of the plates extending at least somewhat above and below the intermediate beam (2). The plates (5,6) are pressed against the intermediate beam by means of bolts, threaded bars (*7a,7b,8a,8b*) or equivalent connecting the plates and passing above and below the intermediate beam so that the plates (5,6) are held in position by the friction generated between the plates and intermediate beam by the pressure, and that the guide rails (11,12) for the elevator car or counterweight and/or their mountings (13,14,15) are secured on the plates (5,6) and/or bolts (*7a,7b,8a,8b*) in a manner known in itself.

34 Claims, 2 Drawing Sheets

PROCEDURE FOR MOUNTING THE GUIDE RAILS FOR AN ELEVATOR CAR OR COUNTERWEIGHT, AND A MOUNTING SYSTEM IMPLEMENTING THE PROCEDURE

FIELD OF THE INVENTION

The present invention relates to a procedure for mounting the guide rails for an elevator car or counterweight, and to a mounting system implementing the procedure, in which the guide rails are attached to an intermediate beam, which in turn is attached at least by one of its ends to opposite walls of the elevator shaft.

BACKGROUND OF THE INVENTION

Intermediate beams are used to divide an elevator shaft vertically into two or more parts forming channels for separate cars moving along guide rails attached to the intermediate beams. Guide rails attached to intermediate beams can also be used to mount counterweights or to accommodate an elevator car in an oversized shaft.

The guide rails for elevator cars or counterweights are secured on the intermediate beams by welding, using various bars and/or plates to connect the vertical rails to the horizontal intermediate beams, which in turn are secured by welding their ends on mounting racks provided on opposite walls of the shaft or by casting the beams in the wall structure during the building stage.

The drawbacks of the previously known procedures for the mounting of guide rails include the difficulty of adjustment of the guide rails due to the rigid welded joints, and the precision requirements imposed by the installation safety condiderations on the person performing the welding, who generally has received special training as an elevator installer, not as a welder. In practice, it is necessary to take the rather large tolerances of the intermediate beams and associated mounting fixtures into account, which retards the installation of the guide rails. Further problems result from the difficulty of supplying electricity for the welding equipment to the required parts of the elevator shaft and the insufficient rigidity of the structures involved in the welding operations (intermediate beams of open cross-section, simple mounting lugs in the walls, etc.) as against the torsional load resulting from frictional forces and the normal forces of the guide load. This ultimately leads to the distortion of the guide rails and a bumpy elevator travel.

SUMMARY OF THE INVENTION

The object of the present invention is to eliminate the above-mentioned drawbacks and to achieve a procedure for mounting the guide rails and associated supporting structures in an elevator shaft enabling a precisely straight alignment of the guide rails to be easily achieved and the rails to be securely mounted without welded joints. The procedure of the invention is characterized in that at least two steel plates or equivalent are placed oppositely on the vertical sides of the intermediate beam, the upper and lower edges of said plates extending at least somewhat above and below the intermediate beam, that the plates are pressed against the intermediate beam by means of bolts, threaded bars or equivalent connecting the plates and passing above and below the beams so that the plates are held in position by the friction generated by the pressure between the plates and the beam, and that the car or counterweight guide rails and/or their mountings are secured on the plates and/or bolts in a matter known in itself.

The other preferred embodiments of the procedure of the invention are characterized by what is presented in the claims to follow.

The system for mounting the guide rails for an elevator car or counterweight as provided by the invention, comprising an intermediate beam laid across the elevator shaft and attached by its ends to opposite walls of the elevator shaft, said beam permitting the guide rails to be secured on it, is characterized in that the system consists of steel plates or equivalent placed oppositely on the vertical sides of the intermediate beam, the upper and lower edges of said plates extending at least somewhat above and below the intermediate beam, and of bolts, threaded bars or equivalent connecting the plates and passing above and below the intermediate beam, enabling the plates to be pressed against the intermediate beam, and elevator or counterweight guide rails and/or their mountings known in themselves and secured on the plates and/or bolts.

BRIEF DESCRIPTION OF THE DRAWINGS

In the following, the invention is described by the aid of examples by referring to the drawings attached, in which.

DETAILED DESCRIPTION OF THE PREFERRED EMBODIMENTS

Figure 1:
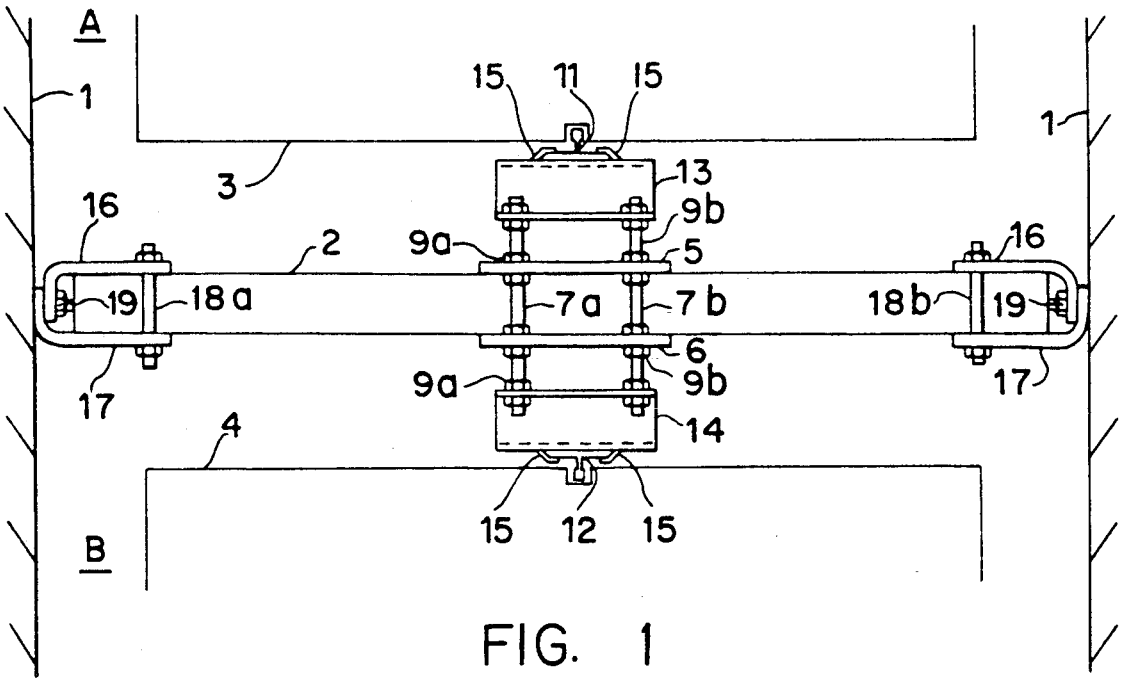
FIG. 1 presents the elevator guide rail mounting system as seen from above.
Figure 2:
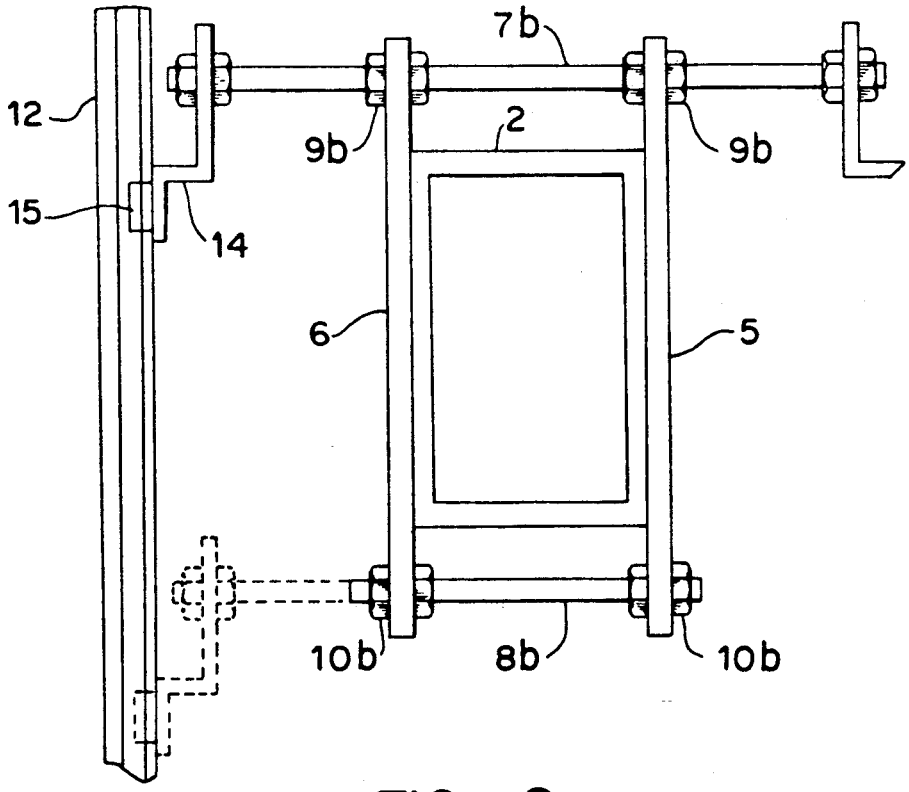
FIG. 2 presents a cross-sectional view the intermediate beam in the system of FIG. 1, and the rail mountings.

FIGS. 1 and 2 illustrate a general embodiment of the elevator guide rail mounting system of the invention. In this embodiment, using intermediate beams 2 placed at even distances through the whole height of the elevator shaft, the shaft 1 is divided into two spaces A and B accommodating elevator cars 3 and 4. Placed oppositely on the sides of the box-like intermediate beam 2 are two steel plates 5 and 6, the upper and lower edges of which extend above and below the intermediate beam 2 so that the plates 5, 6 can be pressed against the intermediate beam 2 by means of threaded bolts 7*a*, 7*b*, 8*a* and 8*b* (not shown in the figure) connecting the plates by their upper and lower edges. When the nuts 9*a*, 9*b* and 10*b*, (hidden) are tightened so as to create a sufficient pressure of the plates 5, 6 against the intermediate beam 2, the resulting friction joint will hold the guide rails 11, 12 of the elevator car 3, 4 fast on the intermediate beam 2. The lock nuts on the opposite sides of the plates 5, 6 corresponding to said tightening nuts, are needed at least in the case of nuts 9*a*, 9*b* to maintain the necessary tension.

The car rails 11, 12 are secured on the intermediate beam 2 by means of angle iron brackets 13 and 14 fastened at the ends of the upper bolts 7*a*, 7*b*. The angle iron brackets are secured with nuts on the ends of the threaded bolts in such manner that the retention claws 15 or equivalent of the brackets will receive the guide rails 11, 12, installed in a vertical position, and lock them in place. The angle iron brackets are provided with oval or elongated holes for the threaded bolts 7*a*, 7*b* to allow transverse adjustment of the bracket position relative to the bolts. The attachment of the elevator rails can be implemented using various techniques obvious to the person skilled in the art and is therefore outside the scope of the present invention. As shown in FIG. 2, the car rails can also be secured by means of angle irons attached to the lower bolt 8*b*, in which case there are two points of attachment of the rail.

As the position and orientation of the steel plates 5, 6 on the intermediate beam 2 can be fully determined and easily changed due to the threaded bolt mounting, the friction joint solution illustrated by FIGS. 1 and 2 substantially facilitates the installation and repair of elevator guide rails. Thus, the guide rails or rail mountings for an elevator car or counterweight can be attached to the intermediate beams by means of threaded bolts pressing them against the beam, the rails can be roughly aligned by adjusting the nuts pressing the plates together, and the fine adjustment fo the alignment can be accomplished by adjusting the nuts holding the rails 11, 12 or their mountings 13, 14.

In FIG. 1, the basic idea of the invention is also applied to the attachment of the intermediate beam 2 to the walls of the elevator shaft 1. The intermediate beam is attached by its ends to opposite walls of the shaft by means of two suitably bent steel plates 16, 17 secured on the wall and with their upper and lower edges extending above and below the intermediate beam, said plates 16, 17 being pressed against the intermediate beam 2 by threaded bolts 18*a*, 18*b* (the lower one is not visible in the figure) connecting the plates and located above and below the beam 2, which is held in place by the friction joint thus produced.

In. FIG. 1, the steel plates 16, 17 are secured on the shaft wall 1 by means of bolts 19, but in a building with a steel framework they can just as well be welded onto the wall or secured on specific points using various mounting fixtures.

Figure 3A:
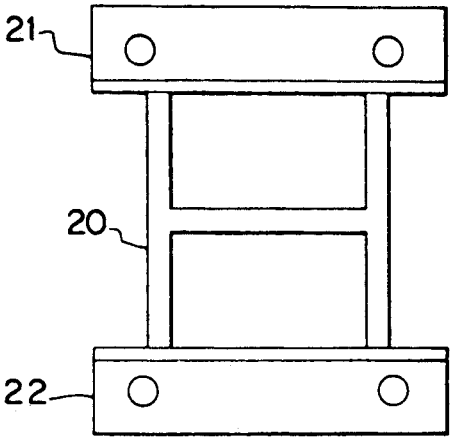
FIGS. 3*a–b* present an embodiment of the system of the invention.
Figure 3B:
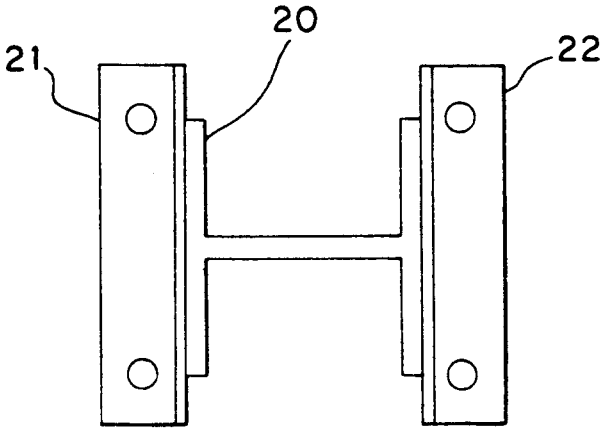

FIG. 3 illustrates the manner in which the intermediate beam can be mounted in the shaft when an ordinary I-beam is used, which is the preferable type of beam in the case of heavy elevators. The angle iron brackets 21, 22 holding the I-beam 20 are fastened to the shaft wall e.g. by means of four bolts and the intermediate beam 20 is mounted between them and tightened in place as shown in FIG. 3*a* or 3*b* along the principles described above. The mountings of the car or counterweight guide rails can likewise be fastened to the intermediate beam as explained in connection with FIGS. 1 and 2.

Figure 4:
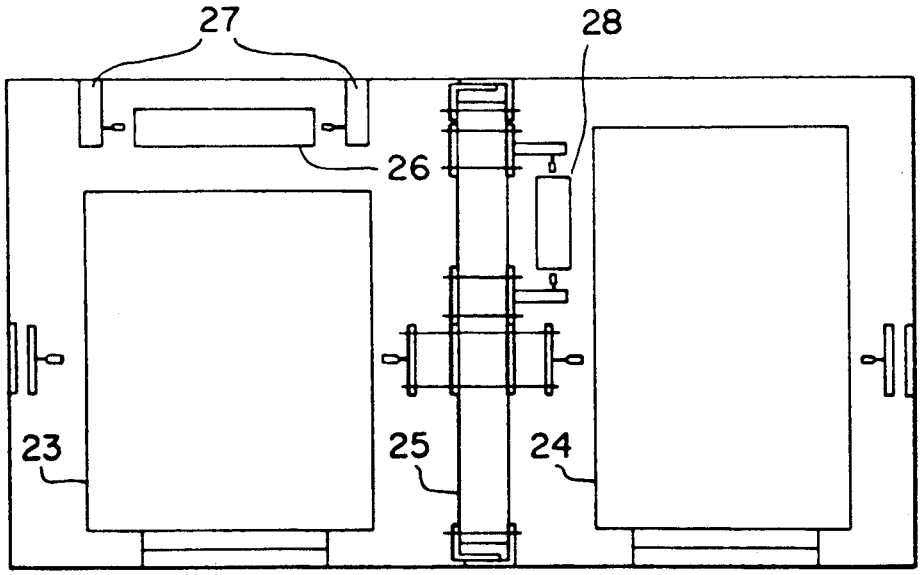
FIG. 4 illustrates an elevator shaft arrangement implemented using the system of the invention.

FIG. 4 shows an example of a shaft layout plan implemented using intermediate beams. The shaft accommodates two elevator cars 23, 24 with an intermediate beam 25 as provided by the invention between them. The guide rails for the counterweight 26 of one 23 of the cars are mounted in the traditional manner on brackets 27 protruding from the shaft wall, whereas the guide rails for the counterweight 28 of the other car 24 are mounted on the intermediate beam. The attachment of both the guide rails for the counterweight and those for the car is implemented as provided by the invention, but it can also be implemented using any other known techniques. The essential point is that the mounting system of the invention using intermediate beams provides more freedom of design of the layout of the car and counterweight guide rails in the elevator shaft.

It is obvious to a person skilled in the art that different embodiments of the invention are not restricted to the examples described above, but that they may instead be varied within the scope of the following claims.

What is claimed is:

1. A mounting system for mounting the guide rails for the elevator car or the elevator counterweight within the elevator shaft comprising:

an intermediate beam having a first end, a second end, a first vertical side, a second vertical side, an upper side, and a lower side, said ends being connected to opposite walls of the elevator shaft;

a first connecting means for connecting said first end to a wall of the elevator shaft;

a second connecting means for connecting said second end to a wall of the elevator shaft;

at least two plates disposed oppositely on said vertical sides, each of said at least two plates having an upper portion extending above said upper side and a lower portion extending below said lower side;

a first plurality of bars extending substantially horizontally between and beyond said upper portions of said plates;

a second plurality of bars extending substantially horizonally between and beyond said lower portions of said plates;

a first plurality of locking means for clamping said plates against said beam;

at least one guide rail; and first mounting means for mounting said at least one guide rail to said first plurality of bars.

2. A mounting system according to claim 1 further comprising second mounting means for mounting said at least one guide rail to said second plurality of bars.

3. A mounting system according to claim 1 wherein said first plurality of locking means is selectively adjustable to align said at least one guide rail.

4. A mounting system according to claim 3 wherein said first mounting means is selectively adjustable to align said at least one guide rail.

5. A mounting system according to claim 4 wherein said first mounting means includes at least one first rail mount, said at least one first rail mount having first attaching means for attaching said at least one guide rail to said at least one first rail mount, and a second plurality of locking means, said second plurality of locking means being separately connectable to said first plurality of bars.

6. A mounting system according to claim 5 wherein said second plurality of locking means is selectively adjustable to align said at least one guide rail.

7. A mounting system according to claim 2 wherein said first locking means is selectively adjustable to align said at least one guide rail.

8. A mounting system according to claim 7 wherein said first mounting means is selectively adjustable to align said at least one guide rail.

9. A mounting system according to claim 8 wherein said second mounting means is selectively adjustable to align said at least one guide rail.

10. A mounting system according to claim 9 wherein said first mounting means includes at least one first rail mount, said at least one first rail mount having first attaching means for attaching said at least one guide rail to said at least one first rail mount, and a second plurality of locking means, said second plurality of locking means being separately connectable to said first plurality of bars.

11. A mounting system according to claim 10 wherein said second mounting means includes at least one second rail mount, said at least one second rail mount having second attaching means for attaching said at least one guide rail to said at least one second rail mount, and a third plurality of locking means, said third plurality of locking means being separately connectable to said second plurality of bars.

12. A mounting system according to claim 11 wherein said second plurality of locking means is selectively adjustable to align said at least one guide rail.

13. A mounting system according to claim 12 wherein said third plurality of locking means is selectively adjustable to align said at least one guide rail.

14. A mounting system according to claim 13 wherein each of said first plurality of bars has screw threads on an outer surface.

15. A mounting system according to claim 14 wherein each of said second plurality of bars has screw threads on an outer surface.

16. A mounting system according to any of claims 1, 2, 3, 4, 5, 6, 7, 8, 9, 10, 11, 12, 13, 14, or 15, wherein said each of said first and second connecting means includes a first angled plate, a second angled plate, each of said first and second angled plates having a first section and a second section, an upper bar, a first affixing means, a lower bar, a second affixing means, a mounting bar, and third affixing means, said first sections of each of said first and second angled plates being disposed on opposite vertical sides of said beam such that said second sections of said angled plates overlap and cover one of said ends of said beam, each of said first and second angled plates having an upper portion extending above said upper side of said beam and having a lower portion extending below said lower side of said beam, said upper bar connecting said opposing upper portions of said angled plates, said first affixing means affixing said first and second angled plates to said beam, said lower bar connecting said opposing lower portions of said first and second angled plates, said second affixing means affixing said first and second angled plates to said beam, said mounting bar extending through said second sections of said first and second angled plates and being embedded in the wall of the elevator shaft, said third affixing being mounted on said mounting bar for affixing said second sections of said angled portions against the wall into which said mounting bar is embedded.

17. A mounting system according to claim 16 wherein each of said upper bar, said lower bar, and said mounting bar has screw threads on an outer surface.

18. A mounting system according to any of claims 1, 2, 3, 4, 5, 6, 7, 8, 9, 10, 11, 12, 13, 14, or 15, wherein each of said sides of said beam has a first end portion and a second end portion, and wherein said each of said first and second connecting means includes a first angled plate, a second angled plate, each of said first and second angled plates having a first section and a second section, said first section including a first portion, a second portion, and a third portion, first, second and third affixing means, at least one first bar, at least one second bar, and at least one mounting bar, said first sections of each of said first and second angled plates being disposed to cover opposite said sides of said beam such that said second sections of said angled plates overlap and cover one of said ends of said beam, each said first portion extending beyond said first end portion of each of said covered opposite sides of said beam, said second portion extending beyond said second end portion of each of said covered opposite sides of said beam, said at least one first bar connecting said opposing first portions, said first affixing means being mounted on said at least one first bar for affixing said first and second angled plates to said beam, said at least one second bar connecting said opposing second portions, said second affixing means being mounted on said at least one second bar for affixing said first and second angled plates to said beam, said at least one mounting bar extending through said second sections of said first and second angled plates and being attached to the wall of the elevator shaft, said third affixing being mounted on said at least one mounting bar for affixing said second sections of said angled plates against the wall to which said at least one mounting bar is attached.

19. A mounting system according to claim 18 wherein each of said at least one first bar, said at least one second bar, and said at least one mounting bar has screw threads on an outer surface.

20. A method for mounting guides for an elevator or an elevator counterweight within an elevator shaft comprising the steps of:

a. mounting an intermediate beam having a first end and a second end between opposite sides of the elevator shaft;

b. providing a guide and a mounting support assembly;

c. mounting said mounting support assembly onto said beam by adjustable clamping means;

d. mounting said guide onto said mounting support assembly by selectively adjustable locking means; and e. selectively adjusting said clamping means to align said guide.

21. A method according to claim 20 comprising the further step of adjusting said locking means to align said guide.

22. A method according to any of claims 20 or 21, wherein the step of mounting said beam includes connecting one of said ends of said beam to one of the opposite sides of the elevator shaft.

23. A method for mounting guide rails for an elevator car or an elevator counterweight within an elevator shaft comprising the steps of:

a. mounting an intermediate beam between opposite walls of the elevator shaft, said beam having opposite vertical sides, opposite upper and lower sides, a first end and a second end, at least one of said ends being connected to a wall of the elevator shaft by a connector;

b. attaching a first plate and a second plate to said beam between said first end and said second end by the use of affixing means, said plates being disposed on opposite vertical sides of said beam, each of said first plate and said second plate having an upper portion extending above said upper side of said beam and having a lower portion extending below said lower side of said beam, said affixing means including a first plurality of bars connecting said opposing upper portions of said plates, a second plurality of bars connecting said opposing lower portions of said plates, and first locking means separately attachable to said first and second plurality of bars to clamp said plates against said beam; and c. attaching at least one guide rail to said first plurality of bars by the use of first mounting means.

24. A method according to claim 23 comprising the further step of: adjusting said first locking means to align said at least one guide rail.

25. A method according to claim 24 comprising the further step of adjusting said first mounting means to align at least one said guide rail.

26. A method according to claim 23 comprising the further step of: attaching said at least one guide rail to said second plurality of bars by the use of second mounting means.

27. A method according to claim 26 comprising the further step of adjusting said first locking means to align said at least one guide rail.

28. A method according to claim 27 comprising the further step of adjusting said first mounting means to align said at least one guide rail.

29. A method according to claim 27 comprising the further step of adjusting said second mounting means to align said at least one guide rail.

30. A method according to claim 28 comprising the further step of adjusting said second mounting means to align said at least one guide rail.

31. A method according to any of claims 23, 24, 25, 26, 27, 28, 29, or 30, wherein the step of mounting said beam by a connector includes the step of mounting a connector assembled from a first angled plate, a second angled plate, each of said first and second angled plates having a first section and a second section, said first sections of each of said first and second angled plates being disposed on opposite vertical sides of said beam such that said second sections of said angled plates overlap and cover at least one of said ends, each of said first and second angled plates having an upper portion extending above said upper side of said beam and having a lower portion extending below said lower side of said beam, said upper bar connecting said opposing upper portions of said angled plates, and said affixing means including an upper bar connecting said opposing upper portions of said angled plates, a lower bar connecting said opposing lower portions of said angled plates, attaching means separately attachable to said upper and lower bars to clamp said angled plates against said beam, a mounting bar, said mounting bar extending through said second sections of said first and second angled plates and being embedded in the wall of the elevator shaft, and seating means mounted on said mounting bar for locking said second sections of said angled plates against the wall.

32. A method according to claim 31, wherein the step of mounting a connector further includes forming a screw thread on an outer surface of each of said upper bar, said lower bar, and said mounting bar.

33. A method according to any of claims 23, 24, 25, 26, 27, 28, 29 or 30, wherein the step of mounting said beam by a connector includes the step of mounting a connector assembled from a first angled plate, a second angled plate, each of said first and second angled plates having a first section and a second section, each of said first sections including a first portion, a second portion, and a third portion, said first sections of each of said first and second angled plates being disposed to cover opposite said sides of said beam such that said second sections of said angled plates overlap and cover at least one of said ends, each said first portion extending beyond a first end portion of each of said covered opposite sides of said beam, each said second portion extending beyond a second end portion of each of said covered opposite sides of said beam, and connecting means for connecting said first and second angled plates to said beam, said connecting means including at least one first bar connecting said opposing first portions, at least one second bar connecting said opposing second portions, attaching means separately attachable to said at least one first bar and said at least one second bar to clamp said angled plates against said beam, at least one mounting bar, said at least one mounting bar extending through said second sections of said first and second angled plates and being attached to the wall of the elevator shaft, and seating means mounted on said mounting bar for seating said second sections of said angled plates against the wall.

34. A method according to claim 33, wherein the step of mounting a connector further includes forming a screw thread on an outer surface of each of said at least one first bar, said at least one second bar, and said at least one mounting bar.

* * * * *